US008536474B2

(12) United States Patent
Fukushima et al.

(10) Patent No.: US 8,536,474 B2
(45) Date of Patent: Sep. 17, 2013

(54) ROTARY SWITCH

(75) Inventors: Hajime Fukushima, Tokyo (JP); Taro Fukunaga, Kanagawa (JP)

(73) Assignee: Tokyo Cosmos Electric Co., Ltd., Kanagawa (JP)

( * ) Notice: Subject to any disclaimer, the term of this patent is extended or adjusted under 35 U.S.C. 154(b) by 166 days.

(21) Appl. No.: 13/256,892

(22) PCT Filed: Feb. 26, 2010

(86) PCT No.: PCT/JP2010/053081

§ 371 (c)(1),
(2), (4) Date: Sep. 15, 2011

(87) PCT Pub. No.: WO2010/106891

PCT Pub. Date: Sep. 23, 2010

(65) Prior Publication Data

US 2012/0006659 A1 Jan. 12, 2012

(30) Foreign Application Priority Data

Mar. 17, 2009 (JP) ..... 2009-064245

(51) Int. Cl.
*H01H 19/00* (2006.01)
*H01H 21/00* (2006.01)

(52) U.S. Cl.
USPC ..... 200/11 A

(58) Field of Classification Search
USPC ..... 200/11 A, 564, 565, 7, 6 R, 17 R, 200/19.03, 19.07, 19.18, 570, 316, 336, 450, 200/520–521
See application file for complete search history.

(56) References Cited

U.S. PATENT DOCUMENTS

| | | | | |
|---|---|---|---|---|
| 7,199,314 | B2 * | 4/2007 | Huang et al. | 200/6 A |
| 2002/0056616 | A1 * | 5/2002 | Amonett | 200/11 A |
| 2012/0152708 | A1 * | 6/2012 | Lipp et al. | 200/336 |

FOREIGN PATENT DOCUMENTS

| | | |
|---|---|---|
| JP | S53-092168 | 12/1976 |
| JP | S53-080576 | 7/1978 |
| JP | S56-070606 | 11/1979 |
| JP | 2007-328974 | 12/2007 |
| JP | 2008-166158 | 7/2008 |

* cited by examiner

*Primary Examiner* — Edwin A. Leon
*Assistant Examiner* — Anthony R. Jimenez
(74) *Attorney, Agent, or Firm* — David N. Lathrop

(57) ABSTRACT

A rotary switch includes a rotor that is insert molded so upper and lower contact pieces have a predetermined number of contact regions with a predetermined angular width in each of a plurality of annular zones defined by a plurality of concentric circles and are stacked in a disk part. The contact pieces are exposed in two surfaces of the disk part, an upper contactor holder and a lower contactor holder are placed to cover a lower half and an upper half of the disk part of the rotor. A plurality of elastic contacts are brought into elastic contact with lower and upper side surfaces of the disk part in a plurality of annular zones, and a rotating operation shaft is inserted through the rotor, the lower contactor holder, and the upper contactor holder, and can rotate the rotor.

5 Claims, 7 Drawing Sheets

ROTARY SWITCH

TECHNICAL FIELD

The present invention relates to a rotary switch in which an operation shaft rotates to open/close switches between a plurality of terminals.

BACKGROUND ART

Recent mobile electronic devices are often requested to have various functions. A rotary switch is used as one means for operations of the functions. Thus, there are various requests for the rotary switch, such as the number of switches, relative timings (relative angle positions) of opening/closing (on/off) of each switch, combination of opening/closing of a plurality of switches, or operation feeling (click feeling) correspondingly to various operations.

FIG. 7 shows an example of a conventional rotary switch disclosed in Patent literature 1. In this conventional example, a circular housing recess 230 is formed at a center of a substantially square insulation body 110, and there are formed on a floor surface of the housing recess 230, an upright support shaft 240 at a center thereof, a ring-shaped common contact piece 290 surrounding the support shaft 240, and a plurality of fixed contact pieces 220 circumferentially arranged outside the common contact piece 290. The common contact piece 290 and the fixed contact pieces 220 are extended to a side edge of the insulation body 110 to form external terminals.

A rotating operation knob 120 includes an operation shaft 570, and an annular click plate 440 integrally formed with the operation shaft 570, and steps 490 and recesses 510 are alternately formed at regular angular intervals in an upper surface of the annular click plate 440. A rotating contactor 130 is secured to a lower surface of the annular click plate 440, and the rotating operation knob 120 is rotatably supported by the support shaft 240 and housed in the housing recess 230 in the insulation body 110.

The circular rotating contactor 130 formed by stamping a spring metal plate has a window at a center thereof, and a forked common slider 790 is formed to protrude on opposite sides of the support shaft 240 in the window. Each tip of the common slider 790 is brought into elastic contact with the common contact piece 290. Middle parts of two arcuate contact pieces formed by circumferentially slitting a peripheral edge of the rotating contactor 130 protrude downward to form switching contacts 680, and the switching contacts 680 slide on the arranged fixed contact pieces 220 and are brought into elastic contact with any one of the fixed contact pieces 220.

A ring-shaped leaf spring 140 is placed on the annular click plate 440 of the rotating operation knob 120. The ring-shaped leaf spring 140 has fixed terminals 830 extended outward from an outer peripheral edge at two points on a diameter thereof. Each fixed terminal 830 is bent 90 degrees downward at an intermediate part, and inserted and secured into an engaging hole 250 formed in each of opposite corners in an upper surface of the insulation body 110.

The ring-shaped leaf spring 140 has engaging protrusions 840 formed to protrude downward at two points on a diameter perpendicular to the diameter passing through the two fixed terminals 830, the engaging protrusions 840 climb the steps 490 in the annular click plate 440 against a spring force by rotation of the rotating operation knob 120, and fit in the recesses 510 by the spring force, thereby causing click feeling in a rotating operation of the rotating operation knob 120.

A substantially square metal case 150 is configured so that the operation shaft 570 protrudes outward through a shaft hole 920 formed at a center thereof, closes the housing recess 230 in the insulation body 110 from above the ring-shaped leaf spring 140 and is secured to the insulation body 110.

PRIOR ART LITERATURE

Patent Literature

Patent literature 1: Japanese Patent Application Laid-Open No. 2008-166158

SUMMARY OF INVENTION

Problems to be Solved by the Invention

In the conventional rotary switch, the operation shaft 570 protruding outward is rotated to bring the common contact piece 290 into conduction with selected one of the fixed contact pieces 220, and provide conduction between two corresponding external terminals. The common contact piece 290 is always brought into conduction with only one fixed contact piece 220. The number of the fixed contact pieces 220 in the circumferential direction, the number of fixed contact pieces 220 that can be selected by changing a circumferential length (angular width), and a rotating angular width of the rotating operation knob 120 that maintains conduction with the same fixed contact piece can be set to desired values, but in the example in FIG. 7, the common contact piece 290 cannot be simultaneously brought into conduction with a plurality of the fixed contact pieces 220. If circumferential angular positions of the two switching contacts 680 are displaced, the common contact piece 290 can be simultaneously brought into conduction with a plurality of the fixed contact pieces 220. However, there is limitation in variety of shapes of the fixed contact pieces 220 that can be placed on the same floor surface and arrangement patterns, and complicated functional operations required of mobile electronic devices cannot be sufficiently accommodated. The present invention has an object to provide a rotary switch that can be designed to have various combinations of opening/closing of a plurality of switches, relative angular positions of opening/closing, or angular widths in a closed state so as to accommodate various functional operations.

Means to Solve the Problems

The present invention provides a rotary switch including: a rotor including a disk part, and a rotation shaft having a shaft hole formed at a center thereof, and insert molded so that a first metal contact piece having a predetermined number of contact regions each having a predetermined angular width in each of one or more first annular zones defined by a plurality of first concentric circles and a second metal contact piece having a predetermined number of contact regions each having a predetermined angular width in each of one or more second annular zones defined by a plurality of second concentric circles are stacked in the disk part, and the contact pieces are exposed in one surface and another surface of the disk part; a first holder having a plurality of first elastic contacts in elastic contact with the one surface of the disk part in the one or more first annular zones; a second holder having a plurality of second elastic contacts in elastic contact with the other surface of the disk part in the one or more second annular zones; and a rotating operation shaft that is inserted through the first holder, the rotation shaft of the rotor, and the second holder, and is configured to rotate the rotor.

Effects of the Invention

According to the present invention, contact piece regions within 360 degrees can be separately determined in radially different annular regions in upper and lower surfaces of the disk part of the rotor. This provides flexibility in design of opening/closing angular ranges of a plurality of switches and relative timings as requested.

DETAILED DESCRIPTION OF THE EMBODIMENTS

Now, embodiments of the present invention will be described in detail.

First Embodiment

Figure 1:
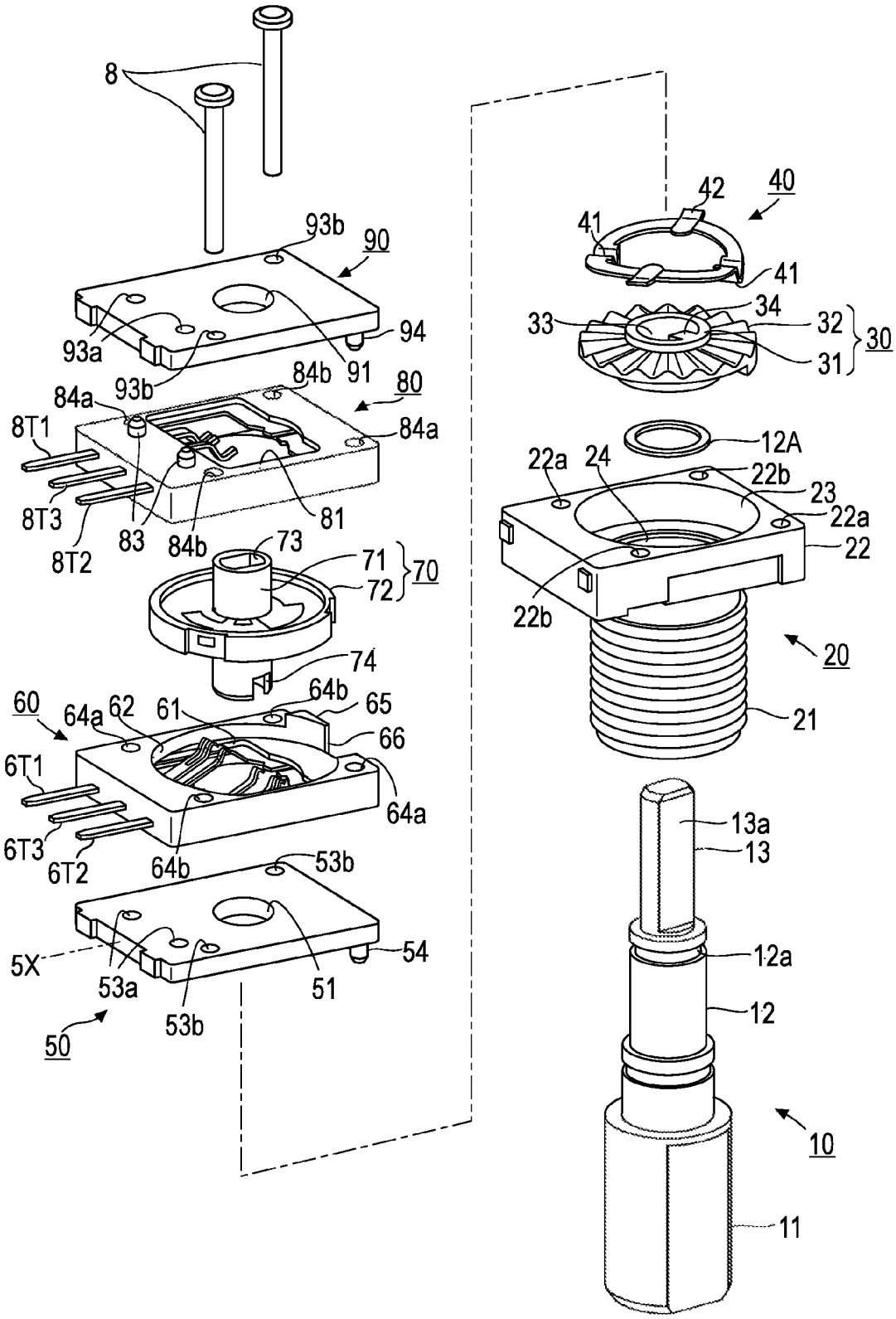
FIG. 1 is an exploded perspective view of a first embodiment of a rotary switch according to the present invention.

FIG. 1 shows a first embodiment of a rotary switch according to the present invention. The rotary switch of the embodiment includes a rotating operation shaft 10, a bearing 20, a click disk 30, a click spring 40, a click spring support plate 50, a lower contactor holder 60, a rotor 70, an upper contactor holder 80, a cover 90, and other components.

The rotating operation shaft 10 is formed of a metal rod into a cylindrical shape, and includes an operation part 11, a holding part 12 coaxially extended from a tip of the operation part 11 and having a smaller diameter than the operation part 11, and a driving part 13 coaxially extended from a tip of the holding part 12 and having a smaller diameter than the holding part 12. An annular groove 12*a* is formed in an outer peripheral surface adjacent to a tip of the holding part 12. At least one plane 13*a* formed by cutting in parallel with a central axis is formed in the driving part 13. In the shown example, two planes parallel to each other are formed symmetrically with respect to the rotation center of the rotating operation shaft 10.

The bearing 20 includes a cylinder part 21 having a mounting thread formed on an outer periphery, and a rectangular housing part 22 integrally formed with one end of the cylinder part 21. At a center of the bearing 20, a shaft hole 24 through which the holding part 12 of the rotating operation shaft 10 is rotatably inserted is formed through the cylinder part 21. In an upper surface of the housing part 22, positioning holes 22*a* are formed in one pair of opposite corners and securing holes 22*b* are formed in the other pair of opposite corners. Further, at a center of the upper surface of the housing part 22, a circular click disk housing recess 23 is formed coaxially with the cylinder part 21, and the shaft hole 24 concentrically passes through a bottom surface of the click disk housing recess 23. A tip of the holding part 12 of the rotating operation shaft 10 inserted through the bearing 20 protrudes from the bottom surface of the click disk housing recess 23, and a ring 12A is fitted to the annular groove 12*a* at the tip for retaining the holding part 12.

Figure 7:
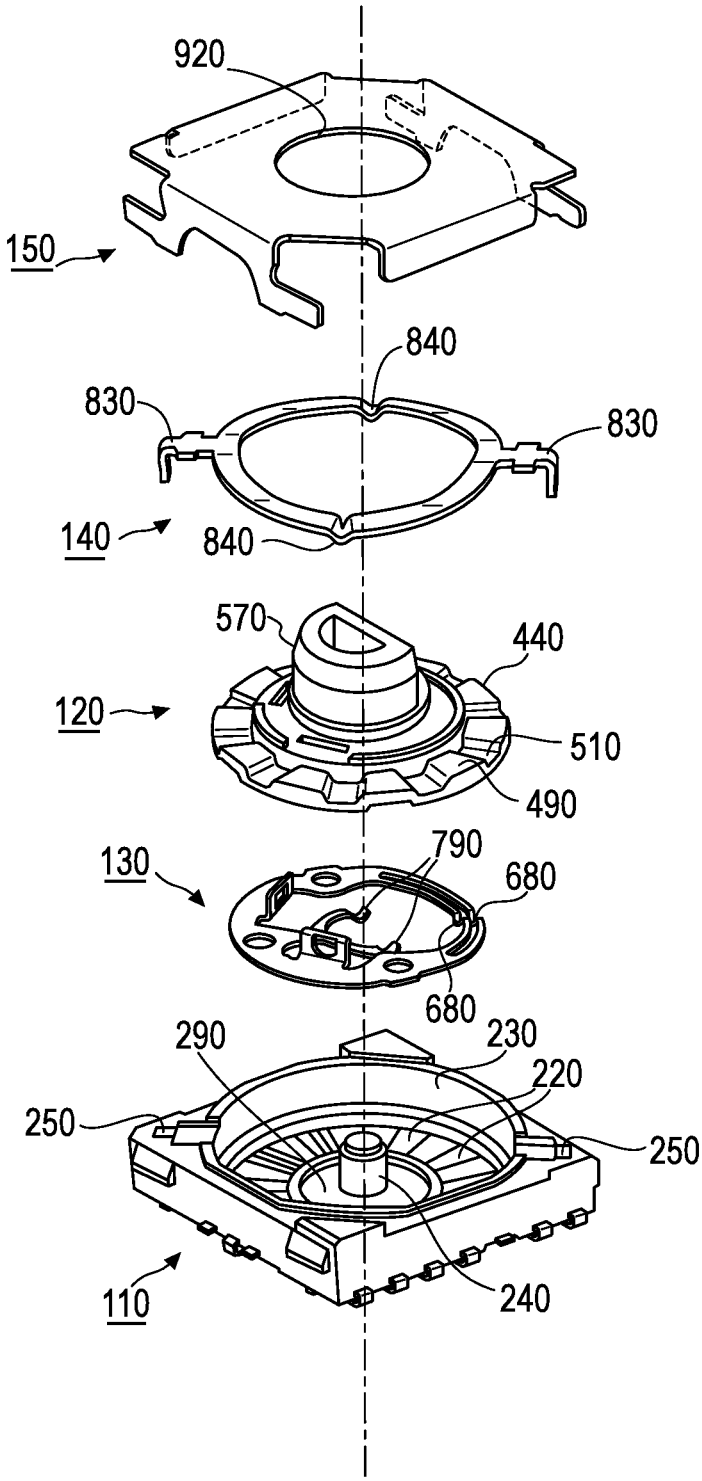
FIG. 7 is an exploded perspective view of a conventional rotary switch.

The click disk 30 includes a shaft part 31 at a center thereof, and in an upper surface outside the shaft part 31, irregularities are circumferentially formed by radially extending ridges 32 like an annular click plate 40 in a conventional art in FIG. 7. The shaft part 31 has a shaft hole 33 through which a rotation shaft 71 of the rotor 70 is axially inserted, and an engaging key 34 protruding from one point on an inner periphery of the shaft hole 33 toward the center and axially extending. An end surface toward the center of the engaging key 34 is a plane brought into contact with and engaging the plane 13*a* of the driving part 13. When the rotating operation shaft 10 is rotated, the plane 13*a* of the driving shaft part 13 inserted into the shaft hole 33 engages the end surface of the engaging key 34 to rotate the click disk 30.

The annular click spring 40 is formed by stamping a spring metal plate, has engaging protrusions 41 protrude toward the click disk 30 at two points on one diameter of an annular part, and further has two fixed terminals 42 extended outward from two points on another diameter perpendicular to the former diameter and extended on extended lines of the diameter. The fixed terminal 42 is bent at an intermediate part substantially 45 degrees with respect to a plate surface toward a side opposite to the click disk 30. The click spring 40 is substantially the same as that in the conventional art in FIG. 7. However, in the conventional art, the fixed terminals are bent 90 degrees, while the fixed terminals are bent 45 degrees in this embodiment, thereby reducing engagement of the click spring support plate 50 with a lock groove 55, and thus reducing a thickness of the click spring support plate 50.

Figure 2A:
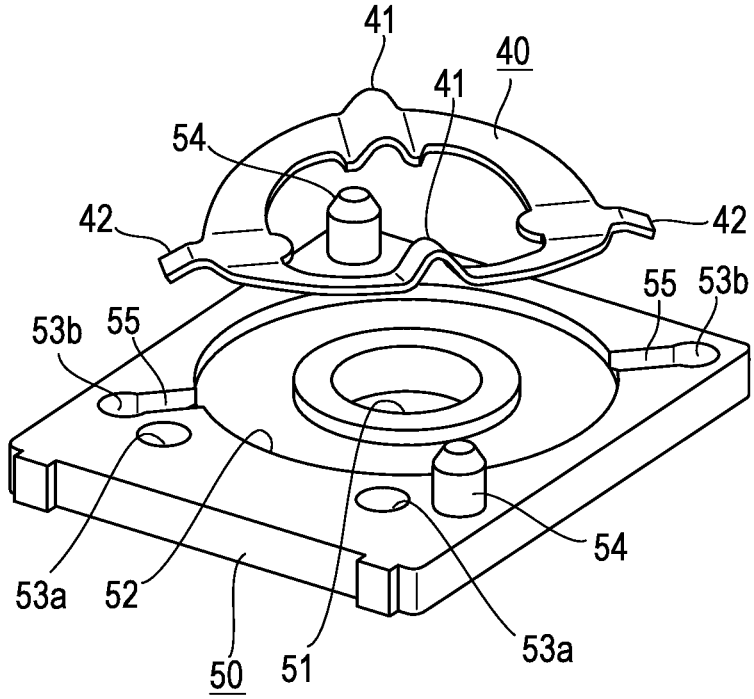
FIG. 2A is a perspective view of a click spring and a click spring support plate to which the click spring has not been mounted.
Figure 2B:
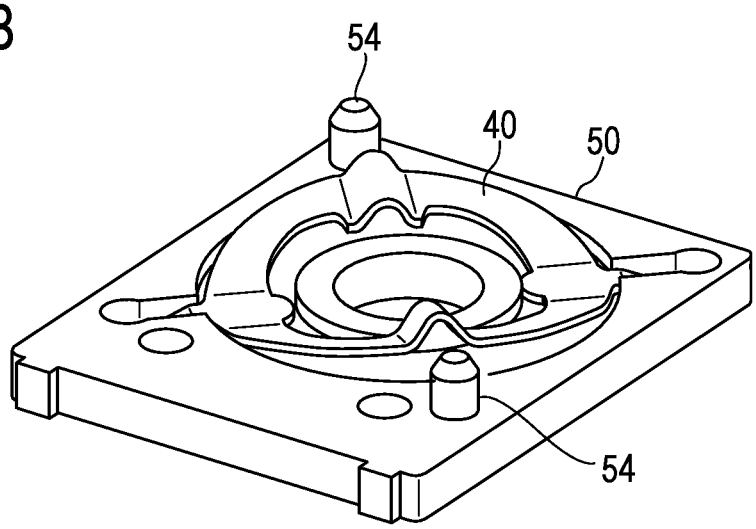
FIG. 2B is a perspective view of the click spring support plate to which the click spring has been mounted.

The click spring 40 is mounted on a lower surface of the click spring support plate 50. FIGS. 2A and 2B are perspective views showing before and after mounting of the click spring 40. A set of the click spring 40 and the click spring support plate 50 in FIG. 1 is shown rotated 180 degrees around a centerline 5X. The click spring support plate 50 is rectangular like the housing part 22, an annular recess 52 that receives the ring-shaped click spring 40 is formed in a lower surface of the click spring support plate 50, and a shaft hole 51 is formed at a center. The shaft hole 51 has a diameter such that the rotation shaft 71 of the rotor 70 described later can be rotatably inserted through the shaft hole 51. Two positioning holes 53*a* are formed adjacent to one side of the click spring support plate 50, securing holes 53*b* are formed near one pair of opposite corners, and positioning protrusions 54 are formed on a lower surface near another pair of opposite corners.

The two fixed terminals 42 of the click spring 40 are inserted and locked into lock grooves 55 formed to extend from the securing holes 53*b* in the support plate 50 toward the center. In that state, the driving part 13 is inserted through the shaft hole 51 in the click spring support plate 50, and mounted to the upper surface of the housing part 22 so as to close the click plate housing recess 23 housing the click disk 30 from above. At this time, the securing protrusion 54 of the click spring support plate 50 is press-fitted and secured in the positioning hole 22*a* in the upper surface of the housing part 22.

Figure 3A:
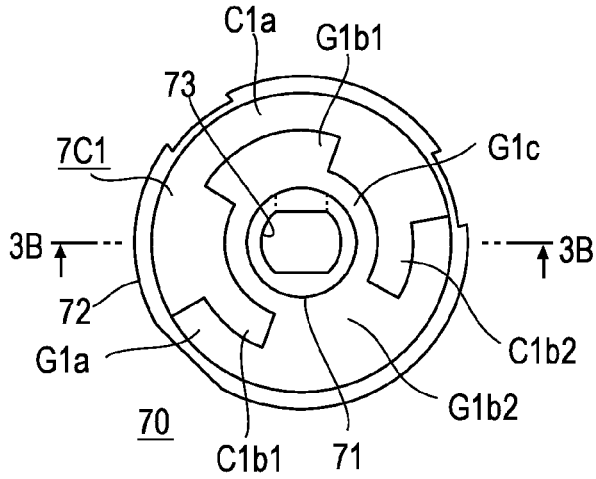
FIG. 3A is a top view of a rotor; rotor.
Figure 3B:
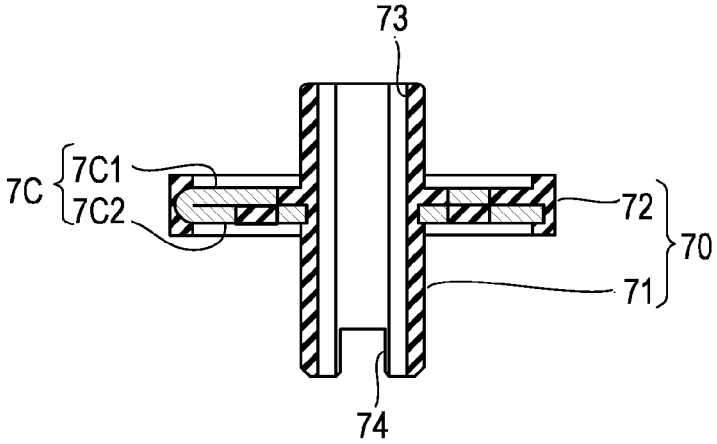
FIG. 3B is a sectional view of the rotor.
Figure 3C:
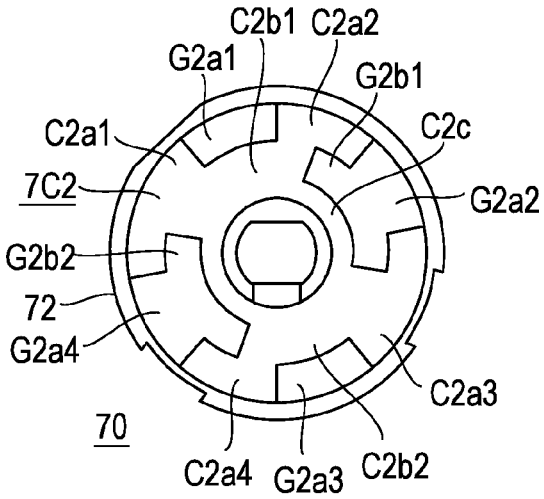
FIG. 3C is a bottom view of the rotor.

FIG. 3A is a top view of the rotor 70, FIG. 3B is a sectional view taken along the line 3B-3B in FIG. 3A, and FIG. 3C is a bottom view of the rotor 70 rotated 180 degrees around the line 3B-3B in FIG. 3A. The rotor 70 includes the rotation shaft 71, a disk part 72 located in a middle in a length direction of the rotation shaft 71 and coaxial with the rotation shaft 71, and a slide contact piece 7C held by the disk part 72 integrally formed by insert molding. The rotation shaft 71 has a shaft hole 73 having the same sectional shape as the shaft hole 33 in the click disk 30. Further, a notch part 74 is formed that is formed by axially cutting one arcuate part at a lower end of the rotation shaft 71 by a predetermined length from the lower end. With the notch part 74, the rotation shaft 71 fits the engaging key 34 in the shaft hole 33 in the click disk 30 through the shaft hole 51, and thus the rotation shaft 71 is inserted into the shaft hole 33*a* by the axial length of the notch part 74.

Figure 4A:
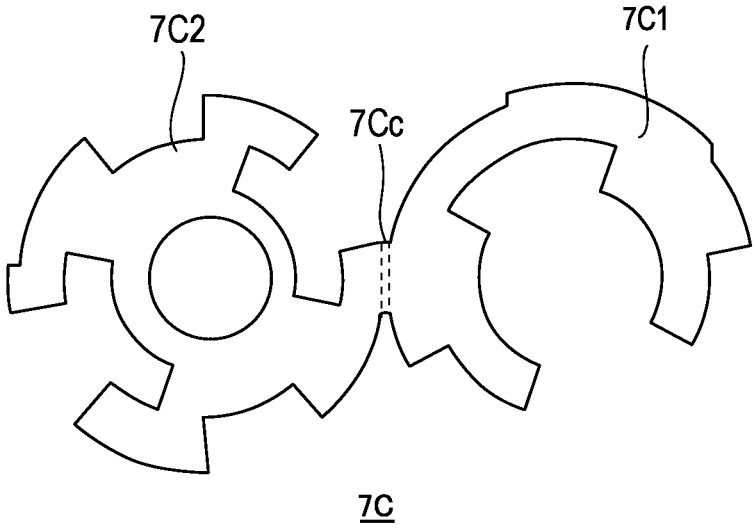
FIG. 4A shows a connection pattern of upper and lower contact pieces.
Figure 4B:
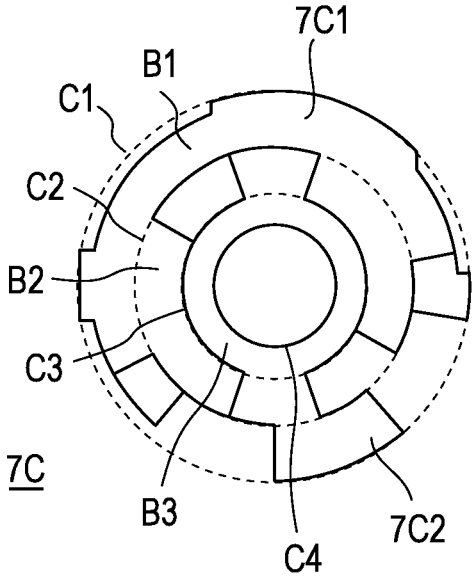
FIG. 4B shows a slide contact piece formed by folding the connection pattern.

The slide contact piece 7C includes an upper contact piece 7C1 and a lower contact piece 7C2, and is formed so that, as shown in FIG. 4A, patterns of upper and lower contact pieces 7C1 and 7C2 obtained by stamping one metal plate and connected to each other are folded at a connecting part 7Cc as shown in FIG. 4B, and the lower contact piece 7C2 is placed on a lower side of the upper contact piece 7C1.

In this embodiment, the upper and lower contact pieces 7C1 and 7C2 are formed to have patterns inscribed in a common circle C1 shown by a broken line in FIG. 4B, and define annular zones B1, B2 and B3 adjacent to each other and having widths between circles C2, C3 and C4 concentric with the circle C1 and successively having smaller diameters, and patterns of contact pieces are previously determined having, as contact piece regions, a desired number of arcuate regions having desired lengths (angular ranges) in a circumferential direction in the annular zones B1, B2 and B3.

In the upper contact piece 7C1 in FIG. 3A, the annular zone B1 includes one contact piece region C1*a* of a predetermined angular range, and an empty region G1*a* of a remaining angular range. The annular zone B2 includes two contact piece regions C1*b*1 and C1*b*2 of a predetermined angular range, and empty regions G1*b*1 and G1*b*2 between the two adjacent contact piece regions. The annular zone B3 includes one (360 degrees) empty region G1*c*. The contact piece regions C1*a*, C1*b*1 and C1*b*2 are regions with a metal surface of the contact piece 7C1 being exposed, and the empty regions G1*a*, G1*b*1, G1*b*2 and G1*c* are insulator surfaces of the disk part 72 flush with surfaces of the contact piece regions.

Meanwhile, in the lower contact piece 7C2 shown in FIG. 3C, the annular zone B1 includes four contact piece regions C2*a*1, C2*a*2, C2*a*3 and C2*a*4 of a predetermined angular range, and empty regions G2*a*1, G2*a*2, G2*a*3 and G2*a*4 between the four adjacent contact piece regions. The annular zone B2 includes two contact piece regions C2*b*1 and C2*b*2 of a predetermined angular range, and empty regions G2*b*1 and G2*b*2 between the two adjacent contact piece regions. The annular zone B3 includes one (360 degrees) contact piece region C2*c*. The contact piece regions C2*a*1, C2*a*2, C2*a*3, C2*a*4, C2*b*1, C2*b*2 and C2*c* are regions with a metal surface of the contact piece being exposed, and the empty regions G2*a*1, G2*a*2, G2*a*3, G2*a*4, G2*b*1 and G2*b*2 are insulator surfaces of the disk part 72 flush with surfaces of the contact piece regions.

In this embodiment, the upper contactor holder 80 and the lower contactor holder 60 have completely the same structure, and contactor holders formed as the same component can be used for an upper one and a lower one by turning upside down. Similarly, the cover 90 and the click spring support plate 50 have completely the same structure. The same structure can reduce production costs of the switch.

Figure 5A:
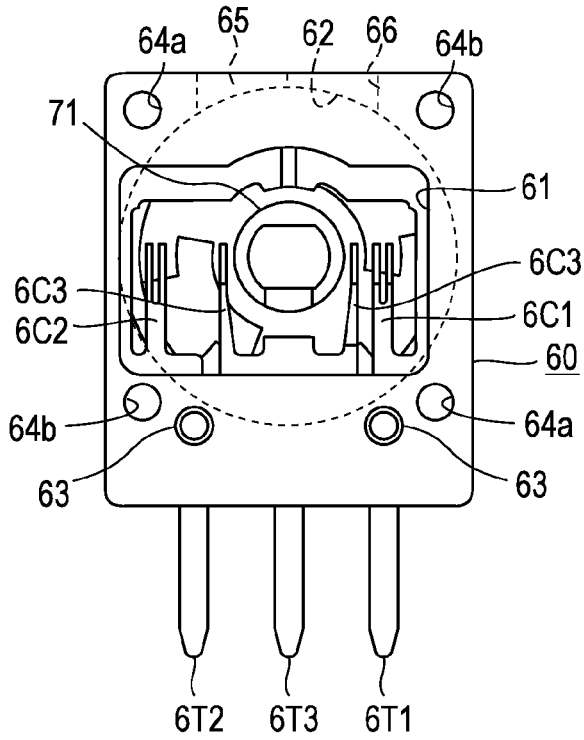
FIG. 5A is a bottom view of a lower contactor holder.

FIG. 5A shows a lower surface of the lower contactor holder 60, and a part of a lower surface of the rotor 70 seen above the lower contactor holder 60. In an upper surface of the lower contactor holder 60, a circular rotor housing recess 62 is formed, and a substantially rectangular window 61 is formed in a floor of the rotor housing recess 62. On a side wall part of the rotor housing recess 62 adjacent to one side of the lower contactor holder 60, an engaging protrusion 65 (also see FIG. 1) protruding from the lower surface toward the upper contactor holder 80, and an engaging recess 66 (also see FIG. 1) adjacent to the engaging protrusion 65 with a side wall part being cut with the same width are formed. Positioning holes 64*a* are formed near a pair of the opposite corners of the lower contactor holder 60, and securing holes 64*b* are formed near another pair of the opposite corners. Further, two positioning protrusions 63 are formed adjacent to one side of the lower contactor holder 60 from which the terminals 6T1, 6T2 and 6T3 are led out.

The lower contactor holder 60 is formed by insert molding together with three elastic contacts 6C1, 6C2 and 6C3 and terminals 6T1, 6T2 and 6T3 integrally extended therefrom and protruding outward from one side surface of the lower contactor holder 60. The three elastic contacts 6C1, 6C2 and 6C3 extend inward from an edge of the window 61, and tips thereof are located on the annular zones B1, B2 and B3 defined in the slide contact piece 7C of the rotor 70. Each of the elastic contacts 6C1, 6C2 and 6C3 has two branch arms, and is brought into two-point contact with each annular zone to increase stability (reliability) of contact and the life.

Figure 5B:
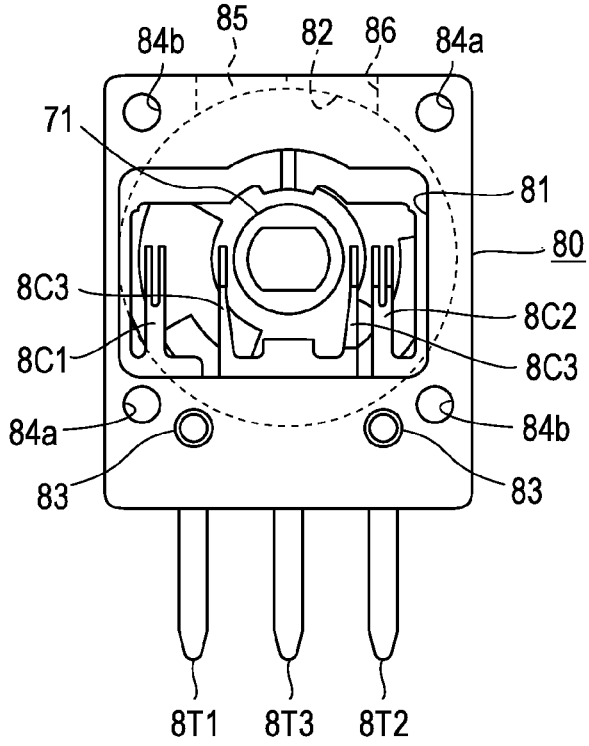
FIG. 5B is a top view of an upper contactor holder.

FIG. 5B shows an upper surface of the upper contactor holder 80 and a part of an upper surface of the rotor 70 seen below the upper contactor holder 80. As described above, the upper contactor holder 80 has completely the same structure as the lower contactor holder 60. A circular rotor housing recess 82 is formed in a lower surface of the substantially rectangular upper contactor holder 80 like the housing part 22, and a substantially rectangular window 81 is formed in a ceiling of the rotor housing recess 82. On a side wall part of the rotor housing recess 82 adjacent to one side of the upper contactor holder 80, an engaging protrusion 85 protruding from the lower surface toward the lower contactor holder 60, and an engaging recess 86 adjacent to the engaging protrusion 85 and formed by cutting the side wall part with the same width. Positioning holes 84*a* are formed at a pair of the opposite corners of the lower contactor holder 80, and securing holes 84*b* are formed at another pair of the opposite corners. Further, two positioning protrusions 83 are formed adjacent to one side of the upper contactor holder 80 from which the terminals 8T1, 8T2 and 8T3 are led out.

The upper contactor holder 80 is formed by insert molding together with three elastic contacts 8C1, 8C2 and 8C3 and terminals 8T1, 8T2 and 8T3 integrally extended therefrom and protruding outward from one side surface of the upper contactor holder 80. The three elastic contacts 8C1, 8C2 and 8C3 extend inward from an edge of the window 81, and tips thereof are located on the annular zones B1, B2 and B3 defined in the slide contact piece 7C of the rotor 70. Each of the elastic contacts 8C1, 8C2 and 8C3 has two branch arms, and is brought into two-point contact with each annular zone.

Returning to FIG. 1, the positioning protrusions 63 (see FIG. 5A) of the lower contactor holder 60 fit in the positioning holes 53*a* in the click spring support plate 50, and the lower contactor holder 60 is positioned and secured on the click spring support plate 50. Then, the driving part 13 of the rotating operation shaft 10 is inserted through the shaft hole 73 in the rotor 70 and a lower end of the rotation shaft 71 is inserted and engaged into the shaft hole 33 in the click disk 30 through the shaft hole 51 in the click spring support plate 50 so that substantially a lower half of the disk part 72 of the rotor 70 is placed in the rotor housing recess 62 in the lower contactor holder 60.

The upper contactor holder 80 is placed on the rotor 70 and placed and secured on the lower contactor holder 60 so that a substantially upper half of the disk part 72 of the rotor 70 is housed in the rotor housing recess 82 in the upper contactor holder 80. At this time, the engaging protrusion 85 and the engaging recess 86 (see FIG. 5B) of the upper contactor holder 80 fit the engaging recess 66 and the engaging protrusion 65 of the lower contactor holder 60, respectively, and are mutually positioned. Further, an upper end of the rotation shaft 71 of the rotor 70 is inserted into the shaft hole 91 in the cover 90, the cover 90 is placed on the upper contactor holder 80 so that the positioning protrusions 94 fit in the positioning holes 84*a* and the positioning protrusions 83 fit in the positioning holes 93*a*. Thus, the elastic contacts 6C1, 6C2 and 6C3 of the lower contactor holder 60 are maintained in elastic contact with the lower surface of the disk part 72 of the rotor 70, and the elastic contacts 8C1, 8C2 and 8C3 of the upper contactor holder 80 are maintained in elastic contact with the upper surface of the disk part 72 of the rotor 70.

With the components thus assembled, two securing pins 8 are inserted through securing holes 93*b* in the cover 90, the securing holes 84*b* in the upper contactor holder 80, the securing holes 64*b* in the lower contactor holder 60, the securing holes 53*b* in the click spring support plate 50, and the securing holes 22*b* in the bearing 20, and the tips of the pins 8 are riveted for integral securing.

The rotary switch is thus assembled, and thus the driving part 13 is inserted through the shaft hole 73 in the rotation shaft 71 of the rotor 70 inserted through the click disk 30 and the click spring support plate 50, and supported in the shaft hole 91 in the cover 90. A cross-section of the shaft hole 73 perpendicular to an axis thereof has a shape formed by cutting out arc portions along straight lines from a circle like the cross-section of the driving part 13. Thus, when the rotor 70 is rotated by rotation of the rotating operation shaft 10, the click disk 30 is also rotated. Thus, the protrusions 41 of the click spring 40 secured to the click spring support plate 50 engage radial irregularities on the rotating click disk 30 to cause click feeling in a rotational operation of the rotating operation shaft 10, and slide contact/separation can be achieved between the upper and lower contact pieces 7C1 and 7C2 of the rotor 70 and the elastic contacts 8C1, 8C2, 8C3 and 6C1, 6C2, 6C3 of the upper and lower contactor holders.

As is understood from the above description, in a conventional case, if a circumferential length (angular width) of one fixed contact piece is determined within 360 degrees, circumferential lengths of the other fixed contact pieces must be determined within a remaining angle, which reduces flexibility in design. On the other hand, in the present invention, the contact piece regions within 360 degrees can be separately determined in radially different annular regions in upper and lower surfaces of the disk part of the rotor 70, which advantageously increases flexibility in design. Specifically, this provides high flexibility in design of opening/closing angular ranges of a plurality of switches and relative timings as requested.

In the above embodiment, the case is described where the common annular zones B1, B2 and B3 are defined in the upper and lower contact pieces 7C1 and 7C2 of the rotor 70. However, the number and width of annular zones may of course be separately defined for the upper and lower contact pieces 7C1 and 7C2, and the number and arrangement of the elastic contacts of the upper contactor holder 80 and the lower contactor holder 60 may of course be determined according to the annular zones on each side.

Second Embodiment

Figure 6:
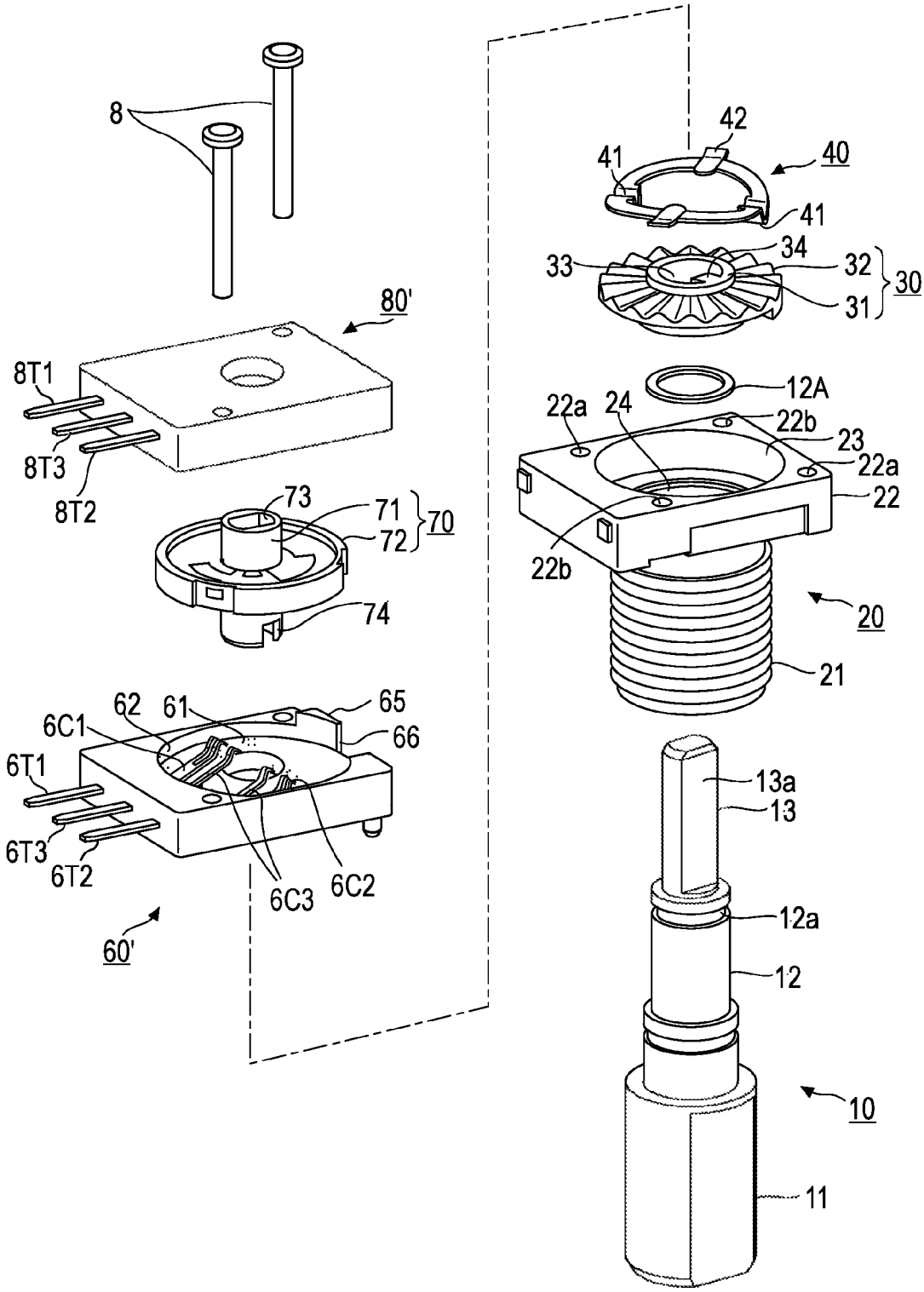
FIG. 6 is an exploded perspective view of a second embodiment of a rotary switch according to the present invention.

FIG. 6 shows a second embodiment of a rotary switch according to the present invention. In the first embodiment described above, the lower contactor holder 60 is integrally formed with the elastic contacts 6C1, 6C2 and 6C3 by insert molding and then the elastic contacts 6C1, 6C2 and 6C3 are bent at a desired angle in the window 61, and thus, the lower contactor holder 60 and the click spring support plate 50 are separately formed. However, when the lower contactor holder 60 can be insert molded with the elastic contacts 6C1, 6C2 and 6C3 being previously bent at a predetermined angle, as shown in FIG. 6, the lower contactor holder 60 and the click spring support plate 50 may be integrally formed as a lower holder (first holder) 60'. Similarly, as shown in FIG. 6, the upper holder 80 and the cover 90 in the first embodiment may be integrally formed as an upper holder (second holder) 80'. Other configurations are the same as in the first embodiment, and descriptions thereof will be omitted.

What is claimed is:

1. A rotary switch comprising:

a rotor including a rotation shaft having a shaft hole formed at a center thereof, a disk part formed integrally and coaxially with the rotation shaft in a middle in a length direction of the rotation shaft and having a first surface and a second surface, and a unitary slide contact piece formed from a single metal plate and held by the disk part, the slide contact piece including a first metal contact section having a predetermined number of first contact regions each having a predetermined angular width in each of one or more first annular zones defined by a plurality of first concentric circles and exposed in the first surface of the disk part and a second metal contact section having a predetermined number of second contact regions each having a predetermined angular width in each of one or more second annular zones defined by a plurality of second concentric circles and exposed in the second surface of the disk part;

a first holder having a plurality of first elastic contacts in elastic contact with the one surface of the disk part in the one or more first annular zones;

a second holder having a plurality of second elastic contacts in elastic contact with the other surface of the disk part in the one or more second annular zones; and a rotating operation shaft that is inserted through the first holder, the rotation shaft of the rotor, and the second holder, and is configured to rotate the rotor;

wherein:

the slide contact piece further includes a connecting section; and the first and second contact sections are connected to each other via the connecting section and folded thereabout directly upon each other.

2. The rotary switch according to claim 1, further comprising:

a bearing including a housing part having a circular click disk housing recess, a click disk housed in the click disk housing recess, having a shaft hole at a center thereof, and having radially extending irregularities on one surface thereof; and a ring-shaped click spring having at least one engaging protrusion that elastically engages irregularities on the click disk, wherein the first holder is mounted on the housing part, and the rotating operation shaft is inserted through the bearing and the click disk, to rotate the click disk together with the rotor.

3. The rotary switch according to claim 2, wherein a notch is formed in one end of the rotation shaft, an engaging key protruding toward a center is formed in the shaft hole in the click disk, the one end of the rotation shaft is inserted into the shaft hole in the click disk, and the notch and the engaging key engage each other.

4. The rotary switch according to claim 2, wherein the first holder includes a lower contactor holder having a rotor housing recess for housing an axial half of the disk part and holding the first elastic contact in the rotor housing recess, and a click spring support plate having one surface that covers the rotor housing recess, and the other surface that supports the click spring, and having a shaft hole communicating with the rotor housing recess.

5. The rotary switch according to claim 2, wherein the second holder includes an upper contactor holder having a rotor housing recess for housing an axial half of the disk part and holding the second elastic contact in the rotor housing recess, and a cover having a surface that covers the rotor housing recess, and having a shaft hole communicating with the rotor housing recess.

* * * * *

UNITED STATES PATENT AND TRADEMARK OFFICE

CERTIFICATE OF CORRECTION

PATENT NO. : 8,536,474 B2
APPLICATION NO. : 13/256892
DATED : September 17, 2013
INVENTOR(S) : Fukushima et al.

It is certified that error appears in the above-identified patent and that said Letters Patent is hereby corrected as shown below:

In the Claims

Column 9 line 17, claim 4, "holding the first elastic contact" should be "holding at least one first elastic contact of the plurality of first elastic contacts".

Column 9 line 25, claim 5, "holding the second elastic contact" should be "holding at least one second elastic contact of the plurality of second elastic contacts".

Signed and Sealed this
Nineteenth Day of November, 2013

Teresa Stanek Rea
*Deputy Director of the United States Patent and Trademark Office*